US010982684B2

(12) United States Patent
Lin et al.

(10) Patent No.: US 10,982,684 B2
(45) Date of Patent: Apr. 20, 2021

(54) CENTRIFUGAL FAN

(71) Applicant: ASUSTeK COMPUTER INC., Taipei (TW)

(72) Inventors: Hsin-Chen Lin, Taipei (TW); Ing-Jer Chiou, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 78 days.

(21) Appl. No.: 16/254,880

(22) Filed: Jan. 23, 2019

(65) Prior Publication Data

US 2019/0242400 A1 Aug. 8, 2019

(30) Foreign Application Priority Data

Feb. 5, 2018 (CN) ..... 201810112304.5

(51) Int. Cl.

| | |
|---|---|
| ***F04D 29/40*** | (2006.01) |
| ***F04D 29/00*** | (2006.01) |
| ***F04D 17/16*** | (2006.01) |
| ***F04D 29/44*** | (2006.01) |
| ***F04D 29/42*** | (2006.01) |

(52) U.S. Cl.

CPC ..... *F04D 29/403* (2013.01); *F04D 17/16* (2013.01); *F04D 29/002* (2013.01); *F04D 29/422* (2013.01); *F04D 29/4246* (2013.01); *F04D 29/441* (2013.01); *F05D 2250/52* (2013.01)

(58) Field of Classification Search

CPC .. F04D 29/4246; F04D 29/002; F04D 29/422; F04D 29/441; F04D 17/16; F04D 29/403

See application file for complete search history.

(56) References Cited

U.S. PATENT DOCUMENTS

| | | | | |
|---|---|---|---|---|
| 6,643,129 | B2 * | 11/2003 | Fujiwara | G06F 1/203 165/104.33 |
| 10,539,150 | B2 | 1/2020 | Ling et al. | |
| 2011/0110774 | A1 * | 5/2011 | Horng | F04D 29/582 415/208.1 |
| 2016/0230651 | A1 * | 8/2016 | Jenks | F02B 37/24 |
| 2016/0369811 | A1 * | 12/2016 | Ling | F04D 29/661 |

FOREIGN PATENT DOCUMENTS

| | | | |
|---|---|---|---|
| CA | 2263265 | A1 | 2/1999 |
| CN | 202065249 | U | 12/2011 |
| CN | 205481414 | U | 8/2016 |
| CN | 106257057 | A | 12/2016 |

* cited by examiner

*Primary Examiner* — Eldon T Brockman
*Assistant Examiner* — Michael K. Reitz
(74) *Attorney, Agent, or Firm* — McClure, Qualey & Rodack, LLP

(57) ABSTRACT

The disclosure provides a centrifugal fan, including an enclosure, a spacer, and a fan blade rotor. The enclosure includes a top panel, a bottom panel, and a side wall connected between the bottom panel and the top panel. The top panel, the bottom panel, and the side wall together form a first air exhaust vent and a second air exhaust vent. The spacer is disposed in the enclosure, is connected between the bottom panel and the top panel, and spaces a first space in communication with the first air exhaust vent and a second space in communication with the second air exhaust vent in the enclosure. The spacer includes a first opening. The first opening is in communication with the first space and the second space. The fan blade rotor is rotatably disposed in the second space.

6 Claims, 5 Drawing Sheets

CENTRIFUGAL FAN

CROSS-REFERENCE TO RELATED APPLICATION

This application claims the priority benefit of China Application Serial No. 201810112304.5, filed on Feb. 5, 2018. The entirety of the above-mentioned patent application is hereby incorporated by reference herein and made a part of specification.

BACKGROUND OF THE INVENTION

Field of the Invention

The disclosure relates to a centrifugal fan.

Description of the Related Art

Generally, a centrifugal fan has two air exhaust vents including a primary air exhaust vent and a secondary air exhaust vent. Where an airflow passes along a rotation direction of fan blades is the primary air exhaust vent. Where the airflow passes along the rotation direction of the fan blades is the secondary air exhaust vent. The air volume and wind pressure of the second air exhaust vent are smaller than that of the primary air exhaust vent. Because the two air exhaust vents have different air exhausting angles and distributions of airflows, heat dissipation capabilities at the two air exhaust vents are not uniform, and the two air exhaust vents generate noise.

BRIEF SUMMARY OF THE INVENTION

The disclosure provides a centrifugal fan, including an enclosure, a spacer, and a fan blade rotor. The enclosure includes a top panel, a bottom panel, and a side wall connected between the bottom panel and the top panel. The top panel, the bottom panel, and the side wall together form a first air exhaust vent and a second air exhaust vent. The spacer disposes in the enclosure and connects the bottom panel and the top panel, and spaces a first space in communication with the first air exhaust vent and a second space in communication with the second air exhaust vent in the enclosure. The spacer includes a first opening. The first opening is in communication with the first space and the second space. The fan blade rotor is rotatably disposed in the second space.

In conclusion, in the centrifugal fan provided in the disclosure, the first air exhaust vent and the second air exhaust vent are formed by using the enclosure, to provide airflows of different directions. The spacer is disposed between the first air exhaust vent and the rotating shaft of the fan blade rotor, to add a segment of a pressurizing region, so that an airflow produced by the centrifugal fan is more stable. The spacer is provided with the first opening and a second opening. Air exhausting volumes and airflow smoothness of the first air exhaust vent and the second air exhaust vent are adjusted by the sizes, positions, and shapes of the first opening and the second opening.

DETAILED DESCRIPTION OF THE EMBODIMENTS

Figure 1:
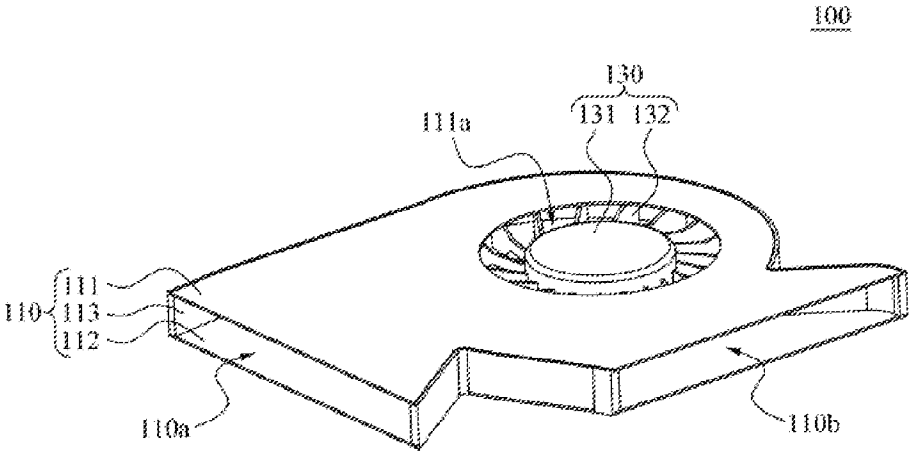
FIG. 1 is a 3D diagram of a centrifugal fan according to an embodiment of the disclosure.
Figure 2:
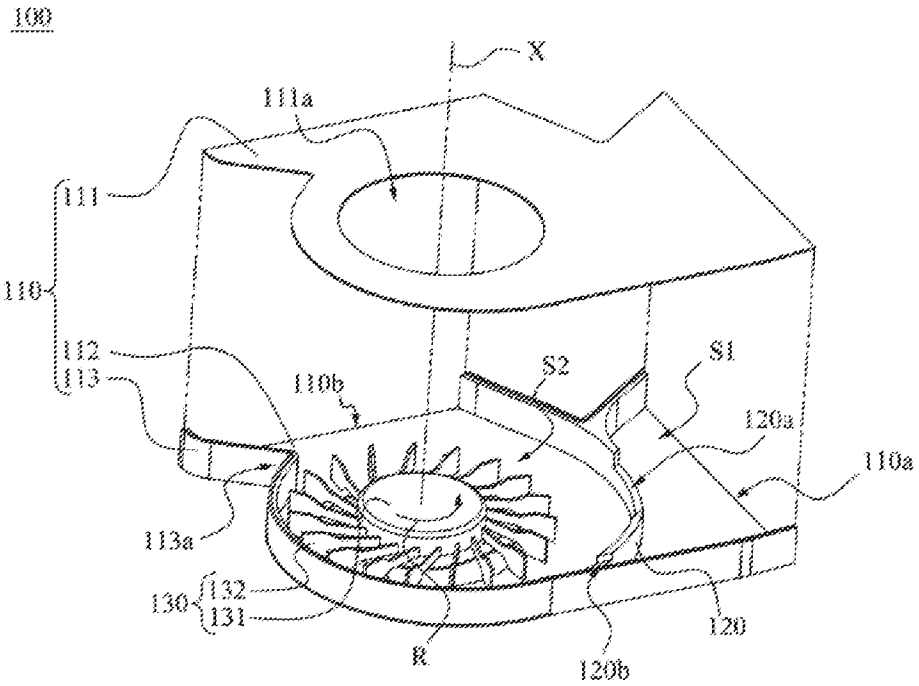
FIG. 2 is a 3D exploded view of the centrifugal fan in FIG. 1.

The disclosure provides a centrifugal fan, including a plurality of air exhaust vents, to satisfy different heat dissipation requirements. Refer to FIG. 1 and FIG. 2. FIG. 1 is a 3D diagram of a centrifugal fan 100 according to an embodiment of the disclosure. FIG. 2 is an exploded view of the centrifugal fan 100 in FIG. 1. As shown in FIG. 1 and FIG. 2, the centrifugal fan 100 provided in the disclosure includes an enclosure 110, a spacer 120, and a fan blade rotor 130.

As shown in FIG. 2, the enclosure 110 includes a top panel 111, a bottom panel 112, and a side wall 113. The side wall 113 is connected to the top panel 111 and the bottom panel 112, and an accommodation space is formed. The top panel 111, the bottom panel 112, and the side wall 113 further define a first air exhaust vent 110*a* and a second air exhaust vent 110*b*. A depressed portion 113*a* is disposed at a position that is on the side wall 113 and that is close to the second air exhaust vent 110*b*.

In this embodiment, an air exhausting direction of the first air exhaust vent 110*a* is perpendicular to an air exhausting direction of the second air exhaust vent 110*b*. In an embodiment, the air exhausting direction of the first air exhaust vent 110*a* and the air exhausting direction of the second air exhaust vent 110*b* are changed arbitrarily according to actual requirements.

As shown in FIG. 2, the spacer 120 is disposed in the enclosure 110, and is connected to the top panel 111, the side wall 113, and the bottom panel 112. The spacer 120 spaces a first space S1 and a second space S2 in the enclosure 110. The first space S1 is a space in communication with the first air exhaust vent 110*a*, and the second space S2 is a space in communication with the second air exhaust vent 110*b*. The spacer 120 includes a first opening 120*a* and a second opening 120*b*. An airflow flows between the first space S1 and the second space S2 through the first opening 120*a* and the second opening 120*b*.

As shown in FIG. 2, the fan blade rotor 130 is rotatably disposed in the second space S2. More specifically, the fan blade rotor 130 is disposed at a position between the depressed portion 113*a* and the spacer 120.

In one embodiment, the fan blade rotor 130 includes a rotating shaft 131 and a plurality of fan blades 132. The fan blade rotor 130 rotates in the enclosure 110 toward a rotation direction R based on an axis X. A position that is on the top panel 111 and that corresponds to the rotating shaft 131 is provided with an air intake vent 111*a*. As shown in FIG. 1, the air intake vent 111*a* completely exposes the rotating shaft 131, and partially exposes the fan blades 132. By using the foregoing configuration, when the fan blade rotor 130 rotates, the air intake vent 111*a* intakes an airflow, so that the airflow flows to the first air exhaust vent 110*a* and the second air exhaust vent 110*b*.

Figure 3:
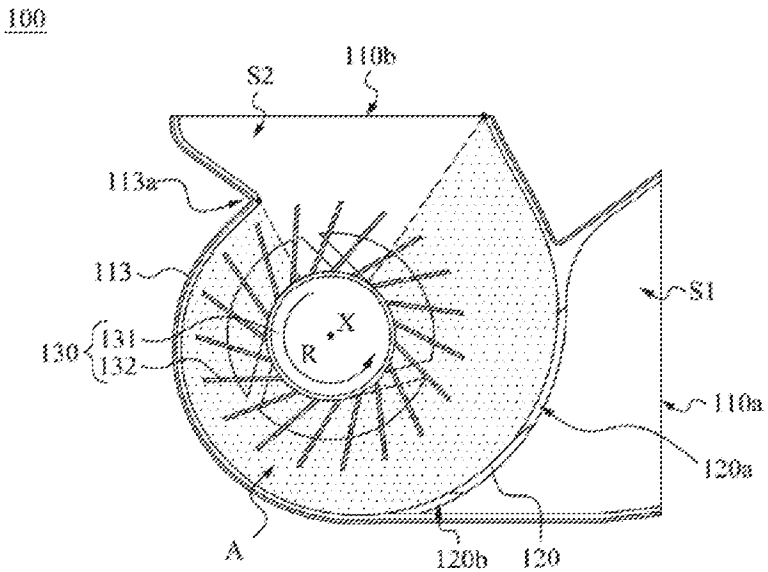
FIG. 3 is a schematic top view of the centrifugal fan FIG. 1 without a top panel.

Referring to FIG. 3, FIG. 3 is a schematic top view of the centrifugal fan 100 in FIG. 1 without the top panel 111. As shown in FIG. 3, a fan blade rotor 130 rotates along a rotation direction R based on an axis X. The rotation direction R is an anti-clockwise direction on the drawing plane of FIG. 3. A distance between a side wall 113 and a rotating shaft 131 gradually increases from the depressed portion 113*a* to a first air exhaust vent 110*a* along the rotation direction R. A distance between a spacer 120 and the rotating shaft 131 gradually increases from the depressed portion 113*a* to a second air exhaust vent 110*b* along the rotation direction R. After an airflow enters regions between the fan blades 132, the airflow is pushed by the fan blades 132 to flow along the rotation direction R. The gradually increasing structure between the side wall 113 and the rotating shaft 131 and the gradually increasing structure between the spacer 120 and the rotating shaft 131 enable the resistance of the airflow to gradually decrease (where a static pressure decreases), so that the speed of the airflow gradually increases (where a velocity pressure increases). Therefore, a region from the depressed portion 113*a* to the second air exhaust vent 110*b* along the rotation direction R among the side wall 113, the spacer 120, and the rotating shaft 131 is defined as a pressurizing region A (that is, a region in which a velocity pressure increases).

As shown in FIG. 3, the spacer 120 includes a first opening 120*a* and a second opening 120*b*. Therefore, when the airflow flows through a region between the spacer 120 and the rotating shaft 131, a part of the airflow flows through the first opening 120*a* and the second opening 120*b* from a second space S2, and flows from a first space S1 to the first air exhaust vent 110*a*. The rest of the airflow flows to the second air exhaust vent 110*b* along the rotation direction R.

As shown in FIG. 3, in the embodiment of the centrifugal fan 100, a region that is on the side wall 113 and that connects the depressed portion 113*a* to the spacer 120 along the rotation direction R (that is, an anti-clockwise direction on the drawing plane) is substantially of an arc surface, thereby ensuring that an airflow in the pressurizing region A flows smoothly. However, in some embodiments, the arc surface is adjusted to other shapes according to actual requirements, such as various conic curves or streamlined curves.

As shown in FIG. 3, in one embodiment of the centrifugal fan 100, a side that is of the spacer 120 and that faces the fan blade rotor 130 includes the arc surface, and a curvature center of the arc surface is located in the second space S2. The arc surface the spacer 120 ensures that the airflow in the pressurizing region A flows smoothly. In an embodiment, the arc surface is adjusted to other shapes according to actual requirements, such as various conic curves or streamlined curves.

As shown in FIG. 3, in the embodiment of the centrifugal fan 100, a part of the second space S2 surrounded by the side wall 113 and the spacer 120 is a cylinder space, so that the airflow in the second space S2 flows smoothly.

Figure 4:
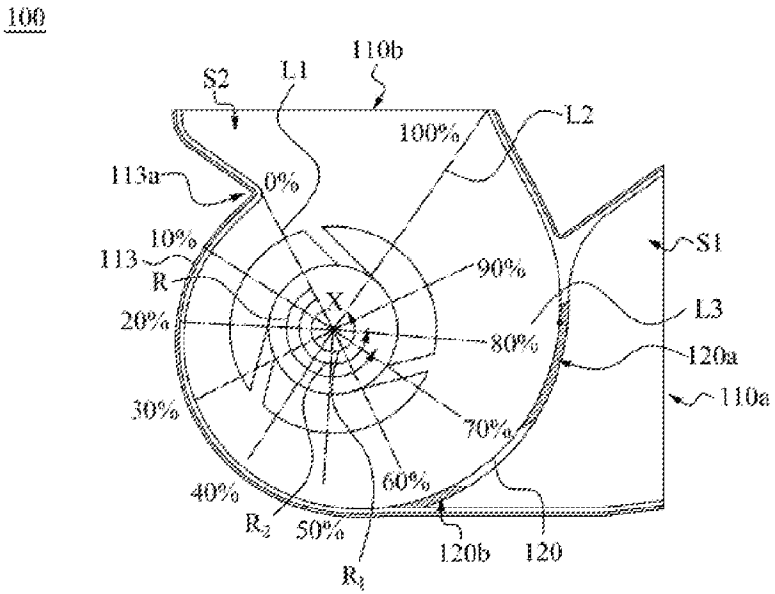
FIG. 4 shows the centrifugal fan in FIG. 3 and shows a position relationship between a first opening and a second opening.

Referring to FIG. 4, FIG. 4 shows the centrifugal fan 100 in FIG. 3 without the fan blades 132, and a position relationship between a first opening 120*a* and a second opening 120*b*. As shown in FIG. 4, on a plane (that is, on the drawing plane of FIG. 4) perpendicular to an axis X, a connection line between the depressed portion 113*a* and the axis X is defined as a first baseline L1; a connection line between the axis X and an end that is of the second air exhaust vent 110*b* and that is distant from the depressed portion 113*a* is defined as a second baseline L2; and a connection line between a point in the first opening 120*a* and the axis X is defined as a third baseline L3.

As shown in FIG. 4, the first baseline L1 rotates by a first angle R1 (which is specifically an obtuse angle between the first baseline L1 and the second baseline L2 along an anti-clockwise direction on the drawing plane) to the second baseline L2 along a rotation direction R. The first baseline L1 rotates by a second angle R2 (which is specifically an obtuse angle between the first baseline L1 and the third baseline L3 along the anti-clockwise direction on the drawing plane) to the third baseline L3 along the rotation direction R. As shown in FIG. 4, a position at which the first baseline L1 rotates by 10% of the first angle R1 along the rotation direction R is marked with 10%. In an embodiment, when the first angle R1 is 300 degrees, 10% of the first angle R1 is 30 degrees, and the position at which the first baseline L1 rotates by 30 degrees along the rotation direction R is marked with 10%. Similarly, a position at which the first baseline L1 rotates by 20% of the first angle R1 along the rotation direction R is marked with 20%, and the reset can be deduced by analogy.

In this embodiment, the second space S2 has the lowest pressure in FIG. 4 at a position marked with 70% to 90%. Therefore, the position marked with 70% to 90% is provided with the first opening 120*a*, to reduce a pressure loss in the second space S2. In actual application, the location of the first opening 120*a* is changed according to requirements. The disclosure is not limited thereto. In different embodiments, a position having the lowest pressure is not necessarily located at the position marked with 70% to 90%, and the position of the first opening 120*a* is designed according to actual conditions.

In the embodiment of the centrifugal fan 100, an airflow flowing through the first opening 120*a* is likely to merely flow to a portion that is of the first air exhaust vent 110*a* and that is close to the second air exhaust vent 110*b*. For uniformity of airflows flowing out of different positions in the first air exhaust vent 110*a*, the second opening 120*b* is provided at a position on the spacer 120 that is more distant from the second air exhaust vent 110*b* than the first air exhaust vent 110*a* is, so that an airflow of the second opening 120*b* flows to a portion that is of the first air exhaust vent 110*a* and that is distant from the second air exhaust vent 110*b*. By using the foregoing setting, overall airflows flowing out of the first air exhaust vent 110*a* are relatively uniform.

In the embodiment of the centrifugal fan 100, an area of the second opening 120*b* is smaller than an area of the first opening 120*a*. As described above, because the first opening 120*a* is provided at the position having a relatively low pressure, and an airflow amount per unit area is relatively small, the first opening 120*a* has a relatively small impact on performance of the second air exhaust vent 110*b*. In comparison, the second opening 120*b* has a relatively large impact on the performance of the second air exhaust vent 110*b*. Therefore, in some embodiments, the area of the second opening 120*b* is designed to be smaller than the area of the first opening 120*a*. In this way, the airflow flows out of the first air exhaust vent 110*a* without greatly affecting the performance such as a flowing amount, a flowing speed, and uniformity of the second air exhaust vent 110*b*. In the embodiment of the centrifugal fan 100, a sum of the areas of the first opening 120*a* and the second opening 120*b* ranges from 10% to 50% of the area of the second air exhaust vent 110*b*. The foregoing design enables that an air exhausting volume of the first air exhaust vent 110*a* is smaller than that of the second air exhaust vent 110*b*, so that the second air exhaust vent 110*b* still maintains a relatively large airflow amount. In actual application, the areas of the first opening 120*a* and the second opening 120*b* are flexibly adjusted to control a proportional relationship between air exhausting volumes of the first air exhaust vent 110*a* and the second air exhaust vent 110*b*.

Figure 5:
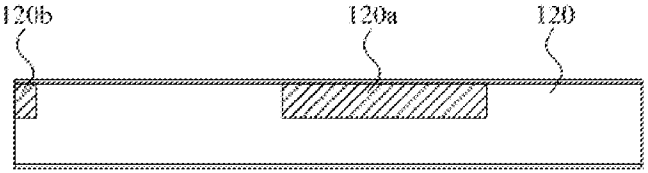
FIG. 5 is a schematic diagram of the centrifugal fan in FIG. 4 in which a first air exhaust vent faces a spacer.

Referring to FIG. 5, FIG. 5 is a schematic diagram of the centrifugal fan 100 in FIG. 4 in which a first air exhaust vent 110*a* faces a spacer 120. As shown in FIG. 5, a first opening 120*a* and a second opening 120*b* are both rectangular. In some embodiments, the first opening 120*a* and the second opening 120*b* are of other shapes. The shapes of the first opening 120*a* and the second opening 120*b* are changed arbitrarily according to actual requirements.

As shown in FIG. 5, a first opening 120*a* and a second opening 120*b* are both connected to a top panel 111 (referring to FIG. 2). In some embodiments, the first opening 120*a* and the second opening 120*b* are connected to a bottom panel 112. In some embodiments, the first opening 120*a* and the second opening 120*b* are connected to the top panel 111 by using the bottom panel 112. In some embodiments, the first opening 120*a* and the second opening 120*b* are located in the spacer 120, and are not connected to the top panel 111 or the bottom panel 112. Disposed positions of the first opening 120*a* and the second opening 120*b* are changed arbitrarily according to actual requirements.

In some embodiments, the spacer 120 is further additionally provided with a third opening, a fourth opening and so on. In an embodiment, the additionally provided openings are located within a range of 70% to 90% in FIG. 4. An opening is additionally provided according to actual requirements, and the disclosure is not limited thereto.

In the centrifugal fan provided in the disclosure, the first air exhaust vent and the second air exhaust vent are formed by using the enclosure, to provide airflows of different directions. The spacer is disposed between the first air exhaust vent and the rotating shaft of the fan blade rotor, to add a segment of a pressurizing region, so that an airflow is more stable in the centrifugal fan. The spacer is provided with the first opening and the second opening. Air exhausting volumes and airflow smoothness of the first air exhaust vent and the second air exhaust vent are adjusted by adjusting the sizes, positions, and shapes of the first opening and the second opening.

The disclosure is described by using examples and the foregoing embodiments. It should be noted that the present invention is not limited to the disclosed embodiments. On the contrary, the present invention includes various modifications and similar arrangements (for example, modifications and arrangements obviously known to a person skilled in the art). Therefore, claims shall cover all similar modifications and arrangements according to the widest explanations.

What is claimed is:

1. A centrifugal fan, comprising:

an enclosure, comprising a top panel, a bottom panel, and a side wall connected between the bottom panel and the top panel, wherein the top panel, the bottom panel, and the side wall together form a first air exhaust vent and a second air exhaust vent which are located at two different sides of the enclosure so that an air exhausting direction of the first air exhaust vent is perpendicular to an air exhausting direction of the second air exhaust vent;

a spacer, disposed in the enclosure, connected between the bottom panel and the top panel, and spacing a first space in communication with the first air exhaust vent and a second space in communication with the second air exhaust vent in the enclosure, wherein the spacer comprises a first opening and a second opening, and the first opening is in communication with the first space and the second space, wherein a distance between the second opening and the second air exhaust vent is greater than a distance between the first opening and the second air exhaust vent, and an area of the second opening is smaller than an area of the first opening; and a fan blade rotor, rotatably disposed in the second space.

2. The centrifugal fan according to claim 1, wherein the side wall comprises a depressed portion, and the fan blade rotor is located between depressed portion and the spacer.

3. The centrifugal fan according to claim 2, wherein the fan blade rotor is configured to rotate along a rotation direction based on an axis and relative to the enclosure, on a plane perpendicular to the axis, a connection line between the depressed portion and the axis is defined as a first baseline, a connection line between the axis and an end that is of the second air exhaust vent and that is distant from the depressed portion is defined as a second baseline, a connection line between a point in the first opening and the axis is defined as a third baseline, the first baseline rotates by a first angle to the second baseline along the rotation direction, the first baseline rotates by a second angle to the third baseline along the rotation direction, and the second angle ranges from 70% to 90% of the first angle.

4. The centrifugal fan according to claim 1, wherein the second opening is connected to the side wall.

5. The centrifugal fan according to claim 1, wherein a sum of areas of the first opening and the second opening ranges from 10% to 50% of an area of the second air exhaust vent.

6. The centrifugal fan according to claim 1, wherein the spacer comprises an arc surface, and a curvature center of the arc surface is located in the second space.

* * * * *